US010906695B2

(12) United States Patent
Hadar

(10) Patent No.: US 10,906,695 B2
(45) Date of Patent: Feb. 2, 2021

(54) COUPLING SYSTEM AND AN ARTICLE EMPLOYING SAME

(71) Applicant: Plasel Plastic Ltd., Lavon Industrial Park (IL)

(72) Inventor: Nir Hadar, Kibbutz Shefayim (IL)

(73) Assignee: PLASEL PLASTIC LTD., Lavon Industrial Park (IL)

( * ) Notice: Subject to any disclaimer, the term of this patent is extended or adjusted under 35 U.S.C. 154(b) by 0 days.

(21) Appl. No.: 16/314,427

(22) PCT Filed: Jun. 27, 2017

(86) PCT No.: PCT/IL2017/050712

§ 371 (c)(1),
(2) Date: Dec. 30, 2018

(87) PCT Pub. No.: WO2018/002920

PCT Pub. Date: Jan. 4, 2018

(65) Prior Publication Data

US 2019/0152649 A1 May 23, 2019

(30) Foreign Application Priority Data

Jun. 30, 2016 (IL) ..... 246559

(51) Int. Cl.
*B65D 21/08* (2006.01)
*B65D 85/20* (2006.01)

(52) U.S. Cl.
CPC ..... *B65D 21/086* (2013.01); *B65D 85/20* (2013.01)

(58) Field of Classification Search
CPC ..... B65D 21/00; B65D 21/08; B65D 21/086; B65D 85/20

(Continued)

(56) References Cited

U.S. PATENT DOCUMENTS 1,189,052 A * 6/1916 Brookshire ..... F16L 37/144 285/303
1,370,207 A * 3/1921 Haase ..... E03B 9/10 220/8

(Continued)

FOREIGN PATENT DOCUMENTS

EP 2848548 B1 5/2016
WO 18042429 A1 3/2018

*Primary Examiner* — Chun Hoi Cheung
*Assistant Examiner* — Brijesh V. Patel
(74) *Attorney, Agent, or Firm* — Dorsey & Whitney LLP

(57) ABSTRACT

A system for axial coupling a first member with a second member is provided. The first member comprises a polygonal locking neck telescopingly receiving a polygonal portion of the second member. An inside wall of the locking neck comprises at least one arresting member and an angular locking member, configured for selectively arresting the angular arresting member and retaining the second member at a locked position. An inside face of the polygonal portion of the second member comprises a flat face portion and an arresting portion extending at a reflex angle with respect to the flat face portion, and a plurality of locking teeth disposed along the arresting portion, each configured for engaging with the at least one arresting member. The flat face portion is partitioned from the arresting portion by an axially extending angular arresting member configured for arresting by the locking member.

18 Claims, 11 Drawing Sheets

(58) Field of Classification Search
USPC ..... 220/8, 4.26, 4.27, 23.83, 23.86, 23.87, 220/23.89, 23.91, 4.03, DIG. 13; 206/1.5, 206/349; 24/455
See application file for complete search history.

(56) References Cited

U.S. PATENT DOCUMENTS 1,450,674 A * 4/1923 Marston ..... A45C 7/0031 220/8
3,425,719 A * 2/1969 Burton ..... F16L 13/161 285/382.2
4,046,279 A * 9/1977 Rosler ..... B65D 21/086 220/8
4,210,253 A * 7/1980 Rosler ..... B65D 21/086 220/8
4,509,656 A * 4/1985 Rosler ..... B65D 21/086 220/8
4,596,340 A * 6/1986 Luther ..... B65D 21/086 220/8
5,562,212 A * 10/1996 Roster ..... B25H 3/003 206/379
5,605,242 A * 2/1997 Hwang ..... B65D 21/086 220/4.03
5,680,949 A 10/1997 Roesler
5,829,591 A * 11/1998 Lyons ..... B65D 25/101 206/591
6,026,685 A * 2/2000 Weterrings ..... G01F 19/00 220/8
7,740,136 B2 * 6/2010 Roesler ..... B25H 3/003 206/379
8,789,694 B2 * 7/2014 Roesler ..... B65D 21/086 206/1.5
9,016,514 B2 * 4/2015 Feldman ..... A47G 23/0216 220/739
D741,709 S 10/2015 Sohler
D747,185 S 1/2016 Roesler
2003/0155274 A1 * 8/2003 Rosler ..... B65D 25/101 206/591
2004/0232016 A1 * 11/2004 Dietrich ..... A63B 55/404 206/315.3
2007/0012696 A1 * 1/2007 Levie ..... B65D 81/266 220/8
2009/0308867 A1 * 12/2009 Lal ..... B65D 21/086 220/8
2013/0068645 A1 * 3/2013 Roesler ..... B65D 11/00 220/4.01
2013/0334220 A1 12/2013 Sohler
2015/0076140 A1 * 3/2015 Roesler ..... B65D 11/00 220/4.01
2015/0076149 A1 3/2015 Roesler
2015/0122768 A1 5/2015 Hadar et al.
2016/0251121 A1 * 9/2016 Hadar ..... B65D 21/08 215/44

* cited by examiner

COUPLING SYSTEM AND AN ARTICLE EMPLOYING SAME

CROSS-REFERENCE TO RELATED APPLICATIONS

This application is a U.S. National Phase Application under 35 U.S.C. 371 of International Application No. PCT/IL2017/050712, which has an international filing date of Jun. 27, 2017, and which claims priority and benefit from Israel Patent Application No. 246559, filed Jun. 30, 2016, the contents and disclosure of both of which are incorporated herein by reference in their entirety.

TECHNOLOGICAL FIELD

The presently disclosed subject matter is directed to a method and system used for coupling of two elements to one another about a common axis thereof. The disclosure is further directed to an article utilizing such a coupling method.

BACKGROUND

Plastic containers are commonly provided for containing therein objects. In some applications, for example for containing precision tools, there are often advantages to providing a container which is of sufficiently size to contain the objects, without being bigger than necessary. Accordingly, such containers must be manufactured to contain a specific object, or provided such that the size is adjustable to be suitable for a wide range of objects. An article which is provided so as to be size-adjustable may also be configured for coupling two cords, for example to facilitate selection of a suitable length therefor.

SUMMARY

A system and an article according to the disclosure is suitable for coupling of a first member and a second member to one another, about a coaxial longitudinal axis, wherein the axial distance between distal ends of the first member and second member is adjustable.

According to a first aspect of the presently disclosed subject matter, there is provided a system for axial coupling a first member with a second member, the first member comprising at least a polygonal locking neck telescopingly receiving a polygonal portion of the second member; at least one inside wall of the locking neck comprising at least one arresting member and an angular locking member; at least one inside face of the polygonal portion of the second member comprising a flat face portion and an arresting portion extending at a reflex angle with respect to the flat face portion, and comprising a plurality of locking teeth disposed along the arresting portion, each configured for engaging with the at least one arresting member; the flat face portion being partitioned from the arresting portion by an axially extending angular arresting member configured for arresting by the angular locking member;

wherein the angular locking member is configured for selectively arresting the angular arresting member and retaining the second member at a locked position at which the at least one arresting member is engaged with the locking tooth of the second member, thereby preventing axial displacement thereof;

and further wherein the polygonal portion of the second member is slidingly displaceable within the polygonal locking neck of the first member only when the flat face portion is substantially parallel with the inside wall surface of the polygonal locking neck and further wherein the second member is axially arrested within the first member when the arresting portion is substantially parallel with the inside wall surface of the polygonal locking neck.

It will be appreciated that the term "telescopingly" is used herein to describe that at least the polygonal portion of the second member is axially displaceable within at least the polygonal locking neck portion of the first member.

According to a second aspect of the disclosure there is disclosed an article comprising a first member and a second member at least partially slidingly received within the first member and axially displaceable there within and configured for selective axial arresting within the first member, the first member comprising at least a polygonal locking neck telescopingly receiving a polygonal portion of the second member; at least one inside wall of the locking neck comprising at least one arresting member and with an angular locking member; at least one external face of the polygonal portion of the second member comprising a flat face portion and an arresting portion extending at a reflex angle with respect to the flat face portion, and comprising a plurality of locking teeth disposed along the arresting portion, each configured for engaging with the at least one arresting member; the flat face portion being partitioned from the arresting portion by an axially extending angular arresting member configured for arresting by the angular locking member;

wherein the angular locking member is configured for selectively arresting the angular arresting member and retaining the second member at a locked position at which the at least one arresting member is engaged with the locking tooth of the second member, thereby preventing axial displacement thereof;

and further wherein the polygonal portion of the second member is slidingly displaceable within the polygonal locking neck of the first member only when the flat face portion is substantially parallel with the inside wall surface of the polygonal locking neck and further wherein the second member is axially arrested within the first member when the arresting portion is substantially parallel with the inside wall surface of the polygonal locking neck.

The arrangement according to the disclosure is such that the second member is angularly displaceable within the first member between an unlocked/open position and locked/closed position. At the unlocked position the locking teeth of the second member are disengaged from the at least one arresting member of the first member and are spaced apart to thereby facilitate free axial (telescopic) displacement of the first member and the second member. However, upon angular displacement of the second member within the first member the locking teeth become engaged with the at least one arresting member and the first member and the second member are axially engaged preventing axial displacement therebetween.

Thus, at the unlocked position, the flat face portion of the second member is substantially parallel and flush against the inside wall surface of the polygonal locking neck and the arresting portion extends at an angle with respect to the inside wall surface thus giving rise to space between the locking teeth and at least one arresting member. At the locked position an opposite situation takes place wherein the flat face portion extends at an angle with respect to the inside wall surface and respectively the arresting portion extends substantially parallel and flush with respect to the inside wall surface so that respective locking teeth engage with the at least one arresting member.

In use, the polygonal portion of the second member is introduced into the first member through the polygonal locking neck, until a desired position, and then the article is manipulated into the locked position as discussed herein above.

It will be appreciated that the term "desired position" as used herein may refer to until an end of the polygonal portion reaches a base end of the first member, or until an end of the locking neck reaches a manipulating portion of the second member, or until an article received within the second member engages the base end of the first member.

According to one particular example the article is a container wherein the first article is a cover member and the second member is a receptacle/carrier member. This configuration is useful when it is required to alter the effective storing length between a base portion of the cover member and a base member of the receptacle member.

According to yet another aspect of the disclosure there is a container comprising a cover member and a receptacle member at least partially slidingly received within the cover member and axially displaceable there within and configured for selective axial arresting within the cover member, the cover member comprising at least a polygonal locking neck telescopingly receiving a polygonal portion of the receptacle member; at least one inside wall of the locking neck comprising at least one arresting member and an angular locking member; at least one external face of the polygonal portion of the receptacle member comprising a flat face portion and an arresting portion extending at a reflex angle with respect to the flat face portion, and comprising a plurality of locking teeth disposed along the arresting portion, each being configured for engaging with the at least one arresting member; the flat face portion being partitioned from the arresting portion by an axially extending angular arresting member configured for arresting by the angular locking member;

wherein the angular locking member is configured for selectively arresting the angular arresting member and retaining the receptacle member at a locked position at which the at least one arresting member is engaged with the locking tooth of the receptacle member, thereby preventing axial displacement thereof;

and further wherein the polygonal portion of the receptacle member is slidingly displaceable within the polygonal locking neck of the cover member only when the flat face portion is substantially parallel with the inside wall surface of the polygonal locking neck, and further wherein the receptacle member is axially arrested within the cover member when the arresting portion is substantially parallel with the inside wall surface of the polygonal locking neck.

Any one or more of the following features, designs and configurations, may be implemented in any one of the aspects and configurations of the method, system and article according to the presently disclosed subject matter, individually or combinations thereof:

- The article may be a container. The container may be used for storage of cutting tools and the like.
- The article may be a coupler for coupling two elements to elements to one another, wherein axial adjustment may be required. According to some examples, it may be a coupler for coupling of cord elements to one another.
- Each of the first member and the second member may comprise locking features, similar to those of the first member or the second member, at a respective opposite end thereof, such that the article may be axially extended.
- Both the first member and the second member may comprise a corresponding polygonal shape. The polygonal shape may extend the entire length of the respective first member and second member, or it may extend only at a respective operating locking portion of each of the first member and the second member.
- The at least one arresting member of the first member may be one or more arresting teeth.
- The one or more arresting teeth and the locking teeth intersect a longitudinal axis of the first member and the second member at a substantially right angle.
- The locking teeth of the second member and the arresting teeth of the first member may be equally distributed along an axial path.
- The first member may be angularly arrested with respect to the second member at the unlocked/open position. According to one particular example, the at least one arresting member of the first ember is provided as one or more inward projection extending from the inside wall surface of the polygonal locking neck, and configured for snapingly arresting at any axial location, over a longitudinal ridge projecting along the external face of the polygonal portion of the second member.
- Angular displacement of the second member within the first member, into the unlocked position, is restricted upon engagement of the corners of the second member with the respective inside walls of the first member.
- The second member may comprise a manipulating portion at a bottom end thereof. According to one particular configuration the manipulating portion has an external shape substantially similar to that of an external shape the first member, such that at the fully retracted, locked/closed position the manipulating portion coextends with the first member.
- The at least one arresting member of the first member, and the plurality of locking teeth of the second member, may be equally spaced along an axial path and may further be of uniform thickness (axially measured), so as to substantially reduce or eliminate axial freedom between the first member and the second member, at the locked position.
- The article, according to a particular example, may have a rectangular cross-section, wherein the at least one arresting member is disposed at a respective side wall, adjacent a following corner thereof, and a plurality of locking teeth are disposed at each arresting portion of the second member, at a following relation and in correspondence with the positioning of the at least one arresting member.
- The at least one arresting member and/or the plurality of locking teeth may be provided as an inclined or coiled pattern, whereby rotational displacement of the first member with respect to the second member, entails simultaneous axial displacement. This arrangement is useful in order to tighten closure of the first member over an article received in the second member.
- One or both of the first member (cover member) and the second member (receptacle member) of a container may comprise a tool receiving/supporting portion.
- One or both of the first member and the second member may comprise indicia (e.g., visible and/or tactile markings) for indicating the locked/unlocked position.

BRIEF DESCRIPTION OF THE DRAWINGS

In order to better understand the subject matter that is disclosed herein and to exemplify how it may be carried out in practice, examples will be described below, by way of non-limiting examples only, with reference to the accompanying drawings, in which.

DETAILED DESCRIPTION

Figure 1B:
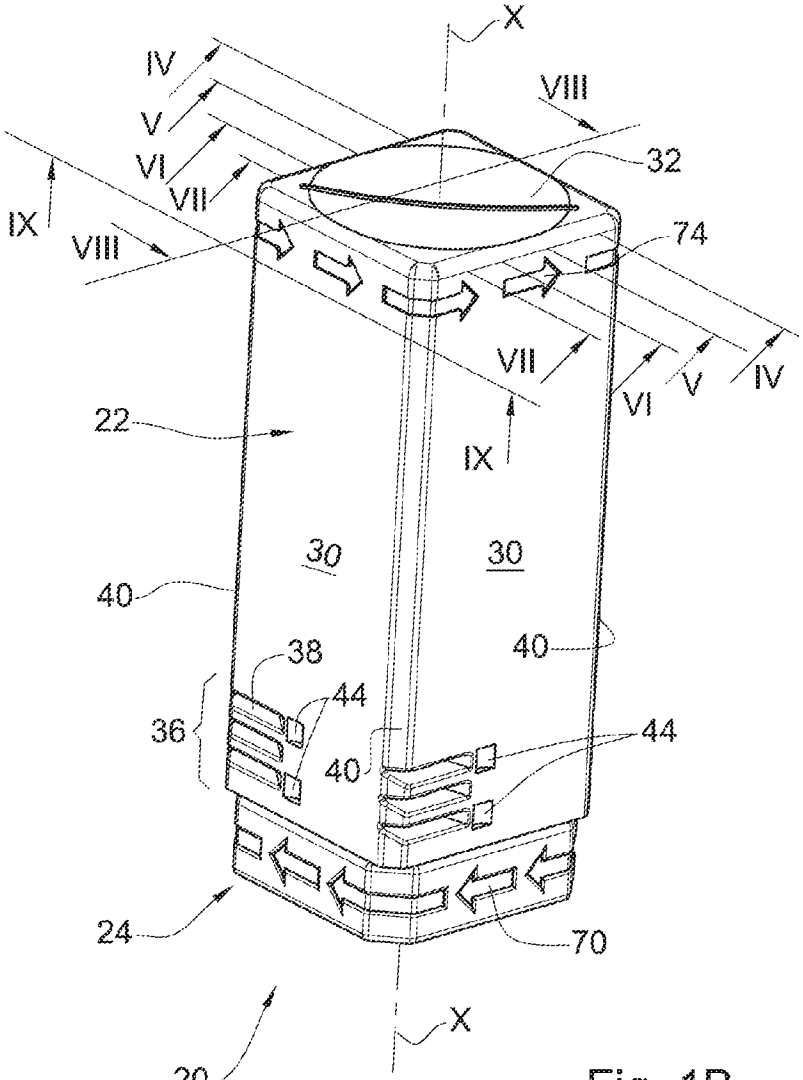
FIG. 1B is a top perspective view of the container of FIG. 1A, the cover member at a fully retracted, locked/closed position.

As illustrated in FIGS. 1A through 7C, there is provided a container 20 having an elongate rectangular shape. The container 20 may be used, e.g., for storage of elongate articles, such as machining tools (drills, mills), needles, and the like. However, it will be appreciated that the system subject of the presently disclosed subject matter and a corresponding article, may assume different shapes. It will be similarly appreciated that the same principles of the disclosure may apply to other types of articles and articles of different shapes, whether or not used as containers.

The container 20 comprises a first member, namely a cover member 22, and a second member, namely receiving member 24, both having a polygonal cross section (square in the present example), made for example of polymeric material and having thin though rigid side walls, rendering the container light weight and yet rigid. The receiving member 24 is coaxially (telescopingly) received within the cover member 22, displaceable along a coaxial longitudinal axis X.

The cover member 22 has four parallely extending side walls 30, a top base 32, and a locking neck portion 36 near an open, bottom end of the cover member 22. The neck portion 36 comprises, at its four side walls, an arresting member by way of three parallely disposed, inwardly projecting (i.e., projecting from an inside surface 31 of the respective side wall) arresting teeth 38 extending at a substantially right angle to the longitudinal axis X, the arresting teeth 38 disposed adjacent following corners 40 of each of the side wall 30.

The cover member 22 further comprises, at each side wall thereof, an angular locking member by way of axially disposed inwardly projecting bulges 44, only slightly spaced apart from the arresting teeth 38.

In the present example the arresting teeth 38 extend from each respective corner, and at a following order at the respective side walls. However, it will be appreciated that the number of arresting teeth and their distribution over the side walls of the cover member may differ (e.g., not extend over each side wall, have more or less teeth, etc.). Likewise, the projecting bulges 44 may be configured differently (e.g., as a continuous projection, or not extend over each side wall).

The second member, i.e., receiving member 24, has a generally rectangular shape and comprising a polygonal portion 48 shaped and sized for sliding insertion into the first member 22, and a manipulating portion 50. The four side walls 54 of the polygonal portion each comprise a flat face portion 56, and an arresting portion 58 extending at a reflex angle $\alpha$ (see FIGS. 2A, 3A and 6B) with respect to the flat face portion 56. The arresting portion 58 comprises a plurality of locking teeth 62 disposed along the arresting portion 58, each configured for engaging with the arresting teeth 38 of the cove member 22. The flat face portion 56 is partitioned from the arresting portion 58 by an axially extending angular arresting member 66, in the form of a longitudinally extending ridge extending at the outside face of the receiving member 24 and configured for snapingly arresting by the angular locking member, i.e., inwardly projecting bulges 44.

It is noted that the locking teeth 62 are shaped, sized and spaced apart in conformity with the arresting teeth 38 of the cover member 22, and are thus configured for arresting and setting an axial position of the second member 24 within the first member 22, as will be discussed hereinafter.

Figure 1A:
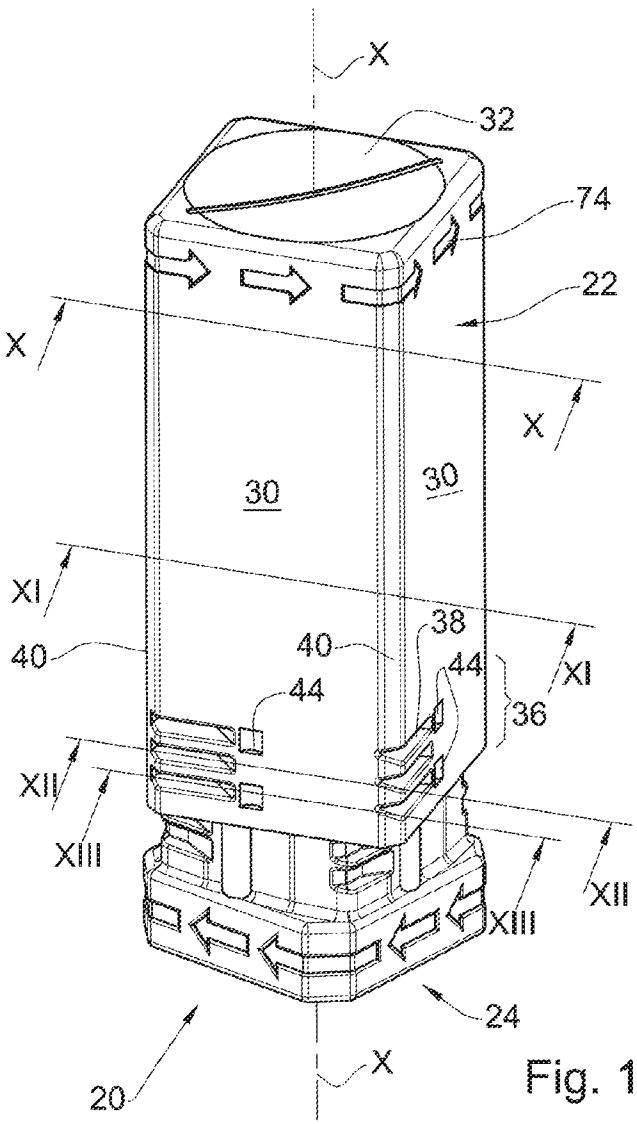
FIG. 1A is a top perspective view of a container according to an example of the disclosure, with the cover member of the container at a partially extracted, unlocked/open position.
Figure 1D:
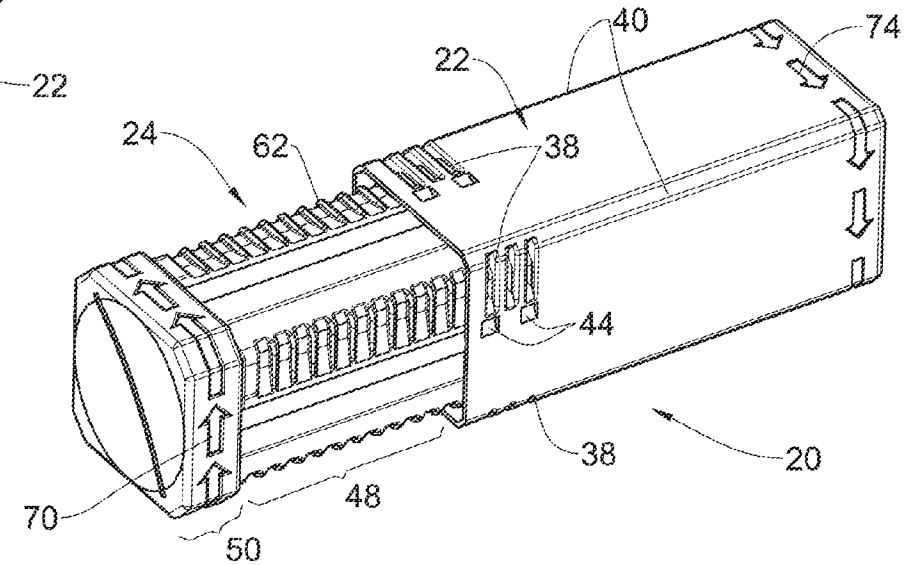
FIG. 1D is a perspective view of the container of FIG. 1B, with the cover further extracted, at the locked position.
Figure 1C:
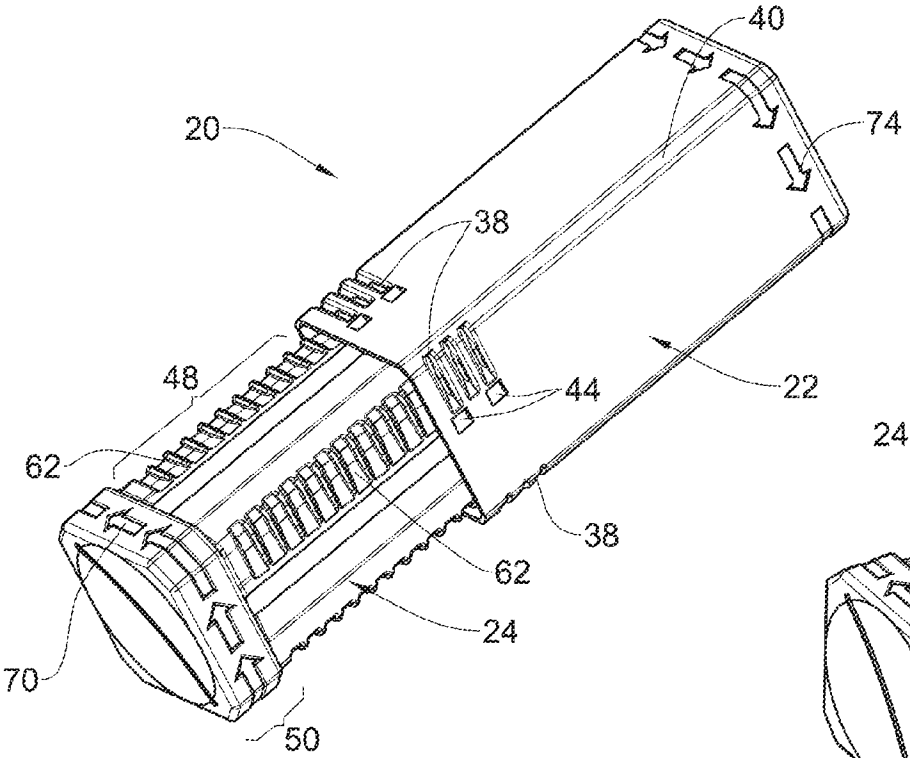
FIG. 1C is a perspective view of the container of FIG. 1A, with the cover further extracted, at the locked/closed position.
Figure 2B:
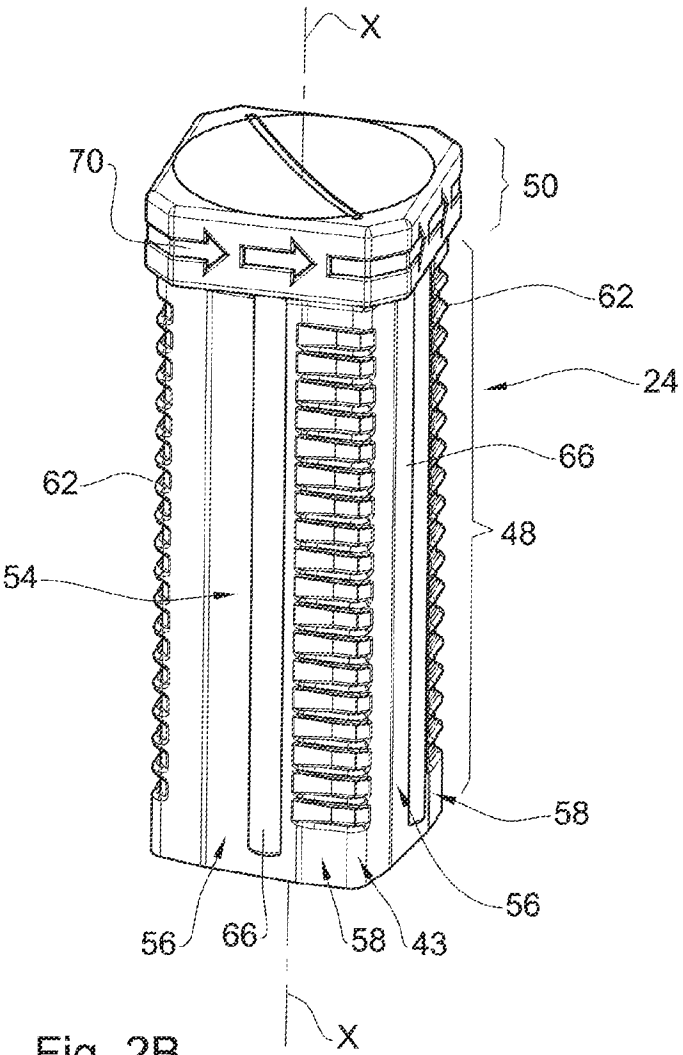
FIG. 2B is a bottom perspective view of a receptacle member of FIG. 2A.
Figure 2A:
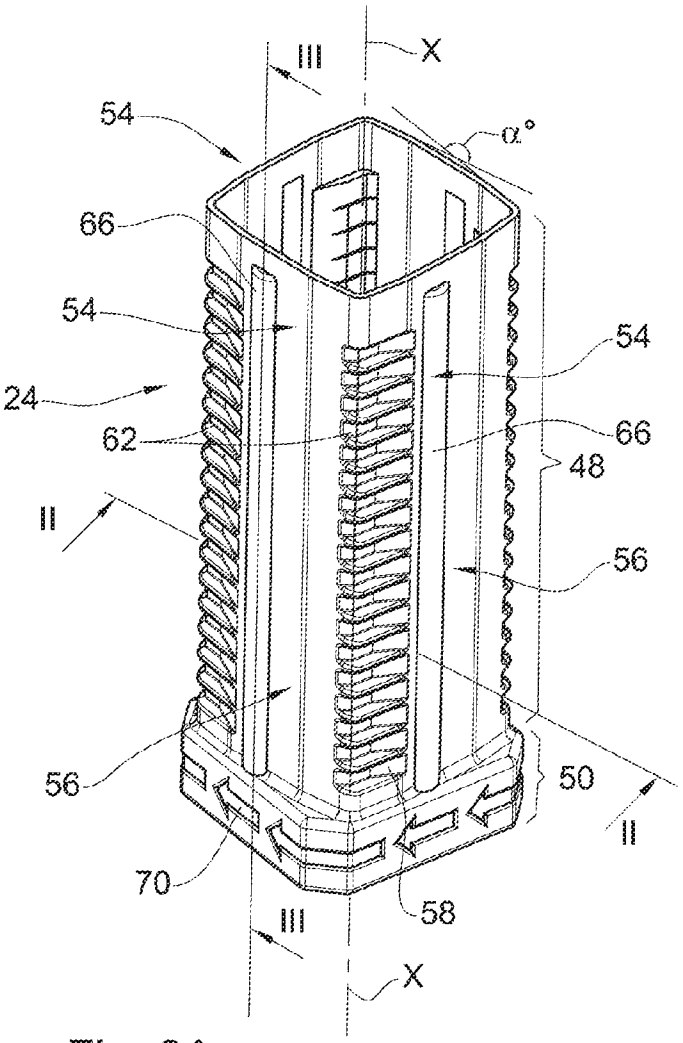
FIG. 2A is a top perspective view of a receptacle member of the container of FIG. 1A.
Figure 3B:
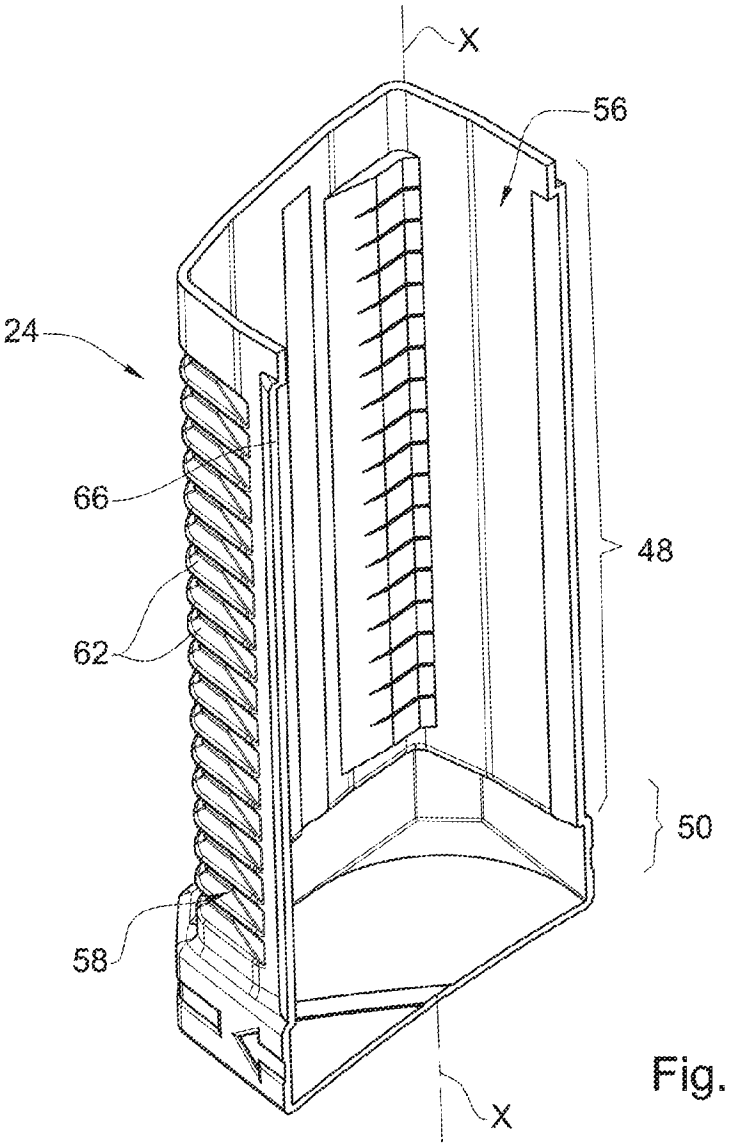
FIG. 3B is section along line in FIG. 2A.
Figure 3A:
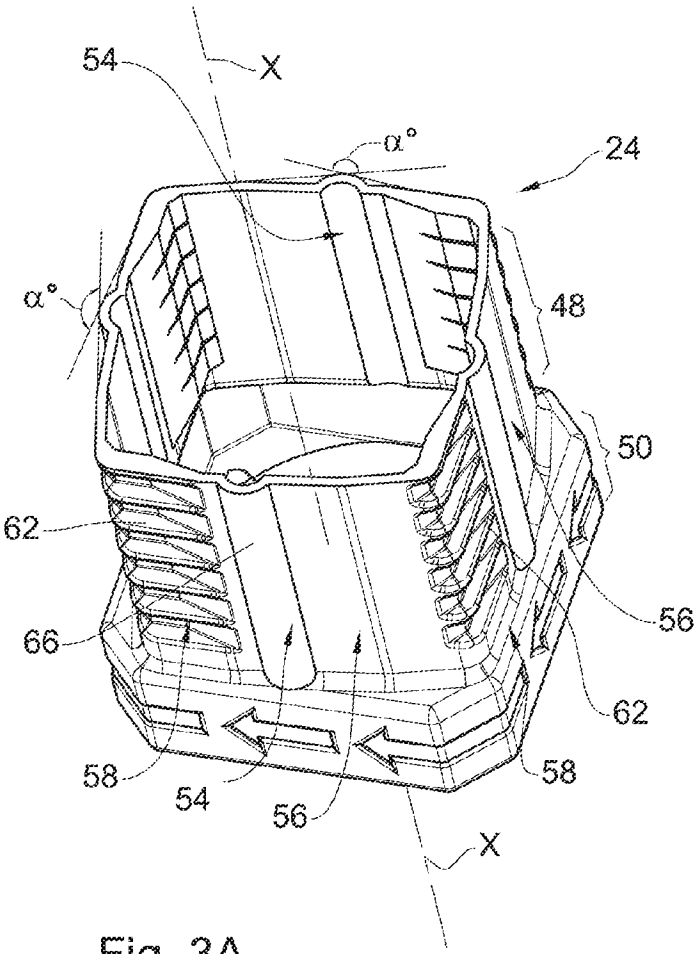
FIG. 3A is section along line II-II in FIG. 2A.
Figure 4B:
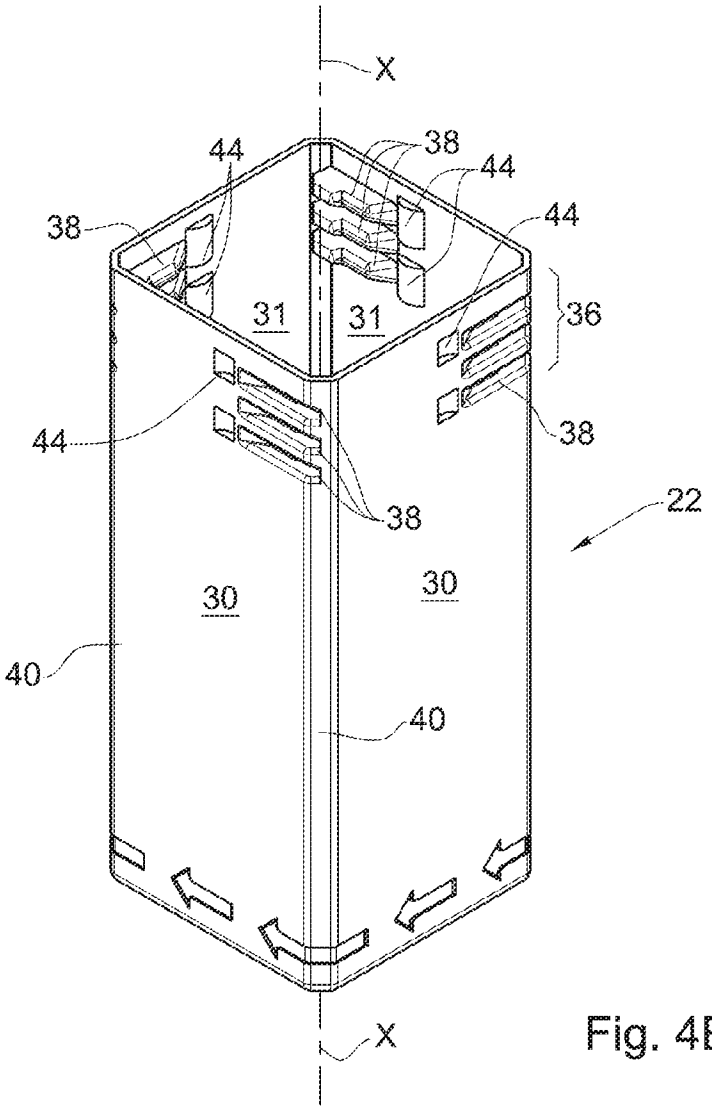
FIG. 4B is a bottom perspective view of a cover member of FIG. 4A.
Figure 4A:
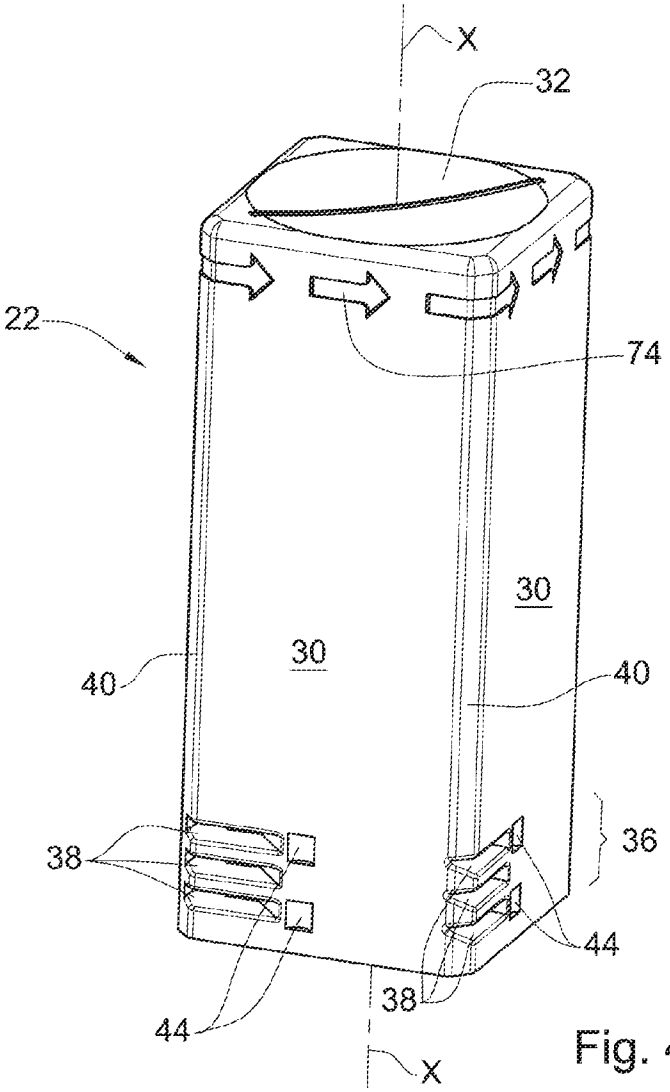
FIG. 4A is a top perspective view of a cover member of the container of FIG. 1A.
Figure 5A:
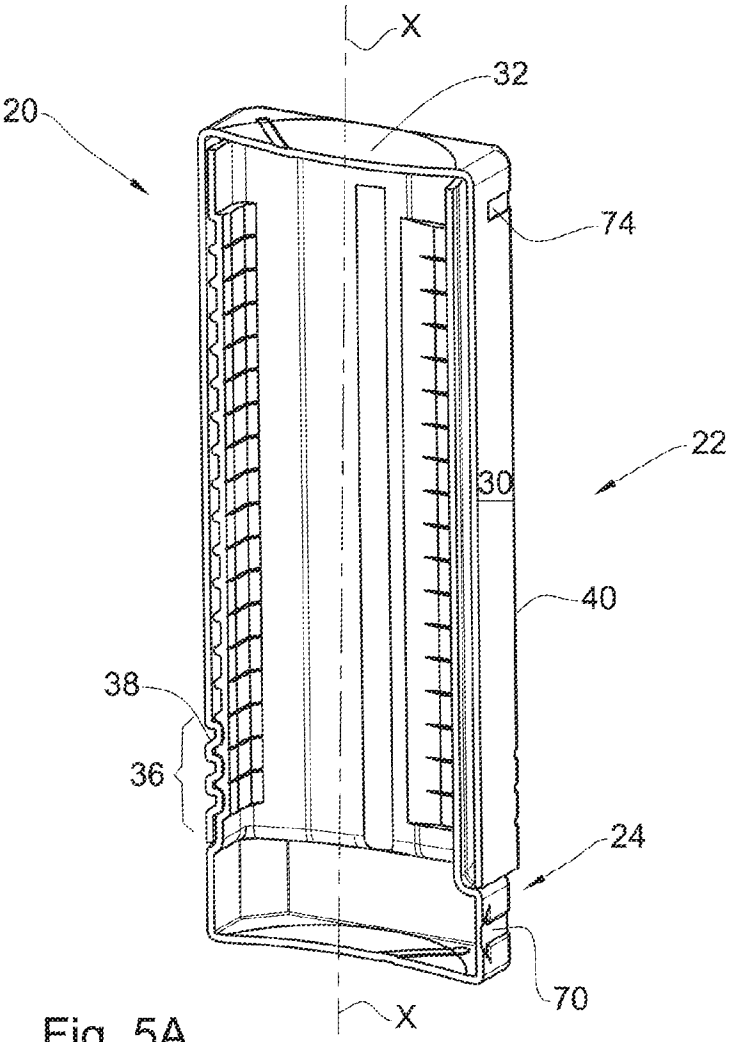
FIGS. 5A to 5E are longitudinal sections along section lines IV-IV, V-V, VI-VI, VII-VII and VII-VIII, respectively, in FIG. 1B.
Figure 5B:
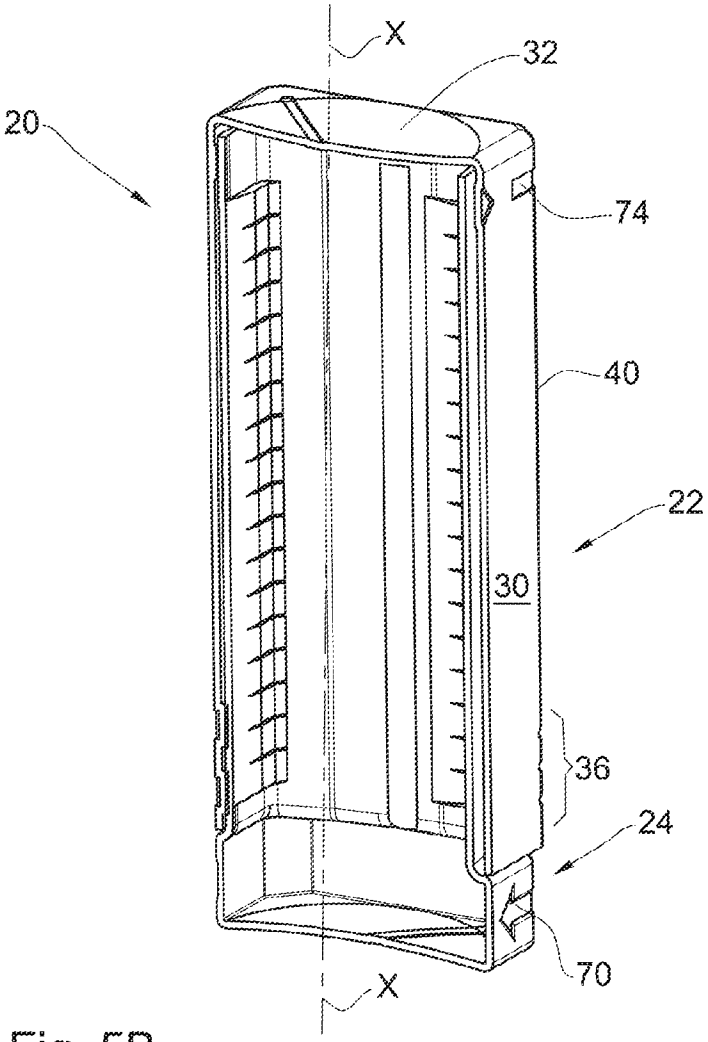
Figure 5E:
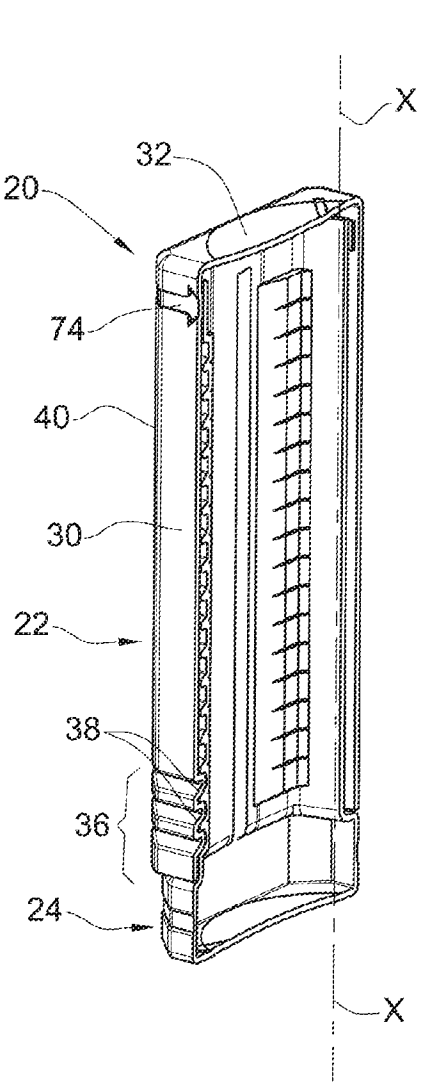
Figure 5D:
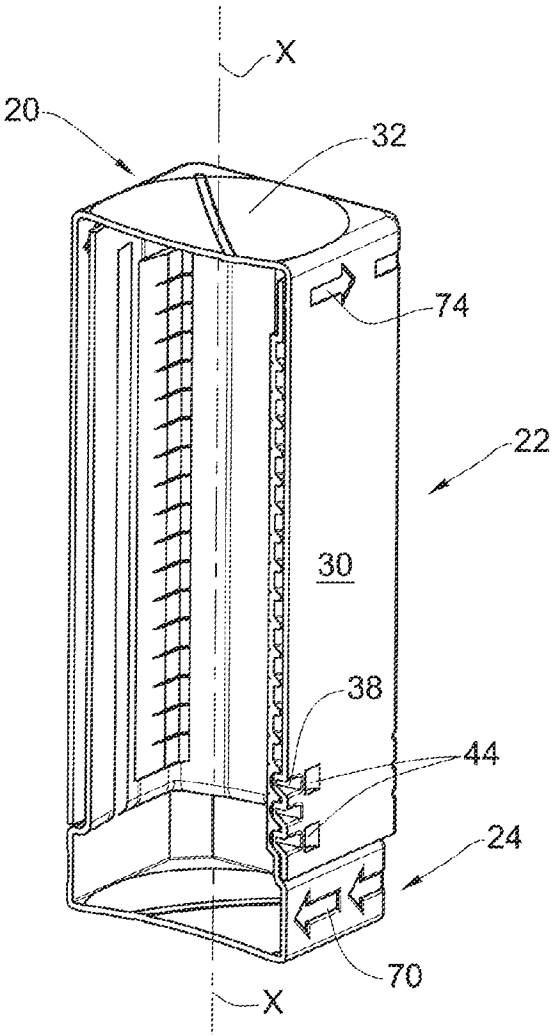
Figure 5C:
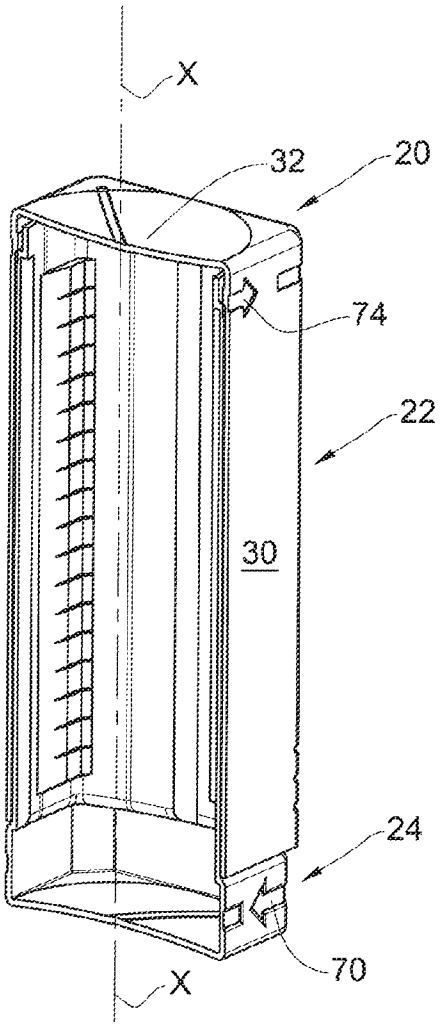
Figure 6B:
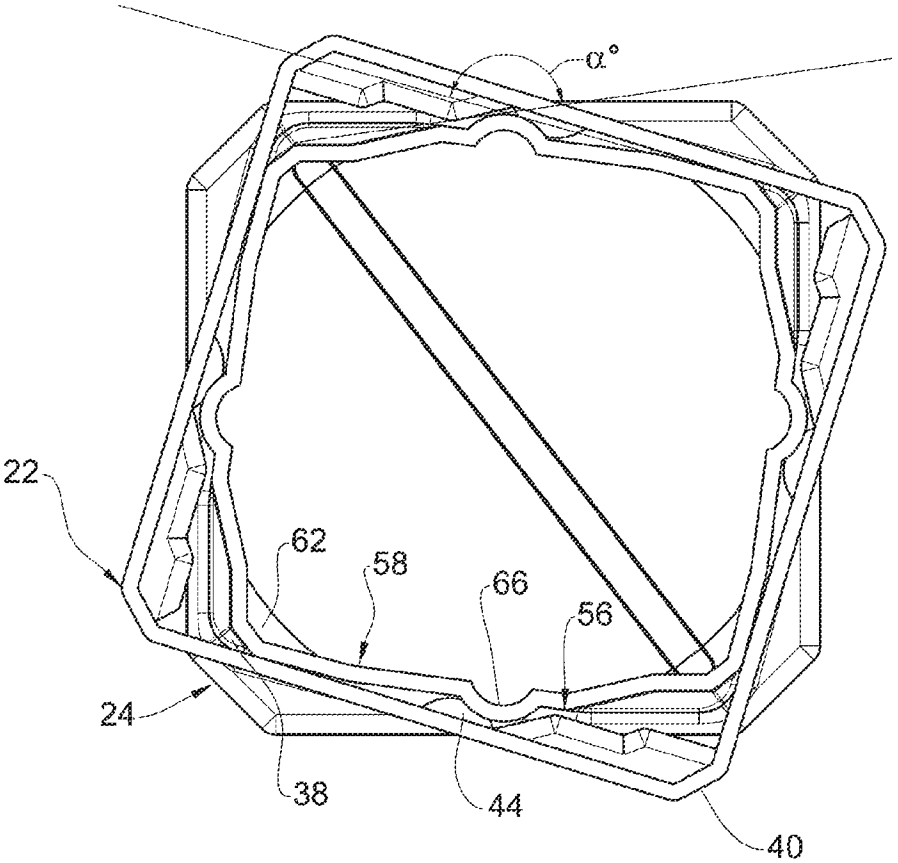
FIG. 6B is a planar section along line X-X in FIG. 1A.
Figure 6A:
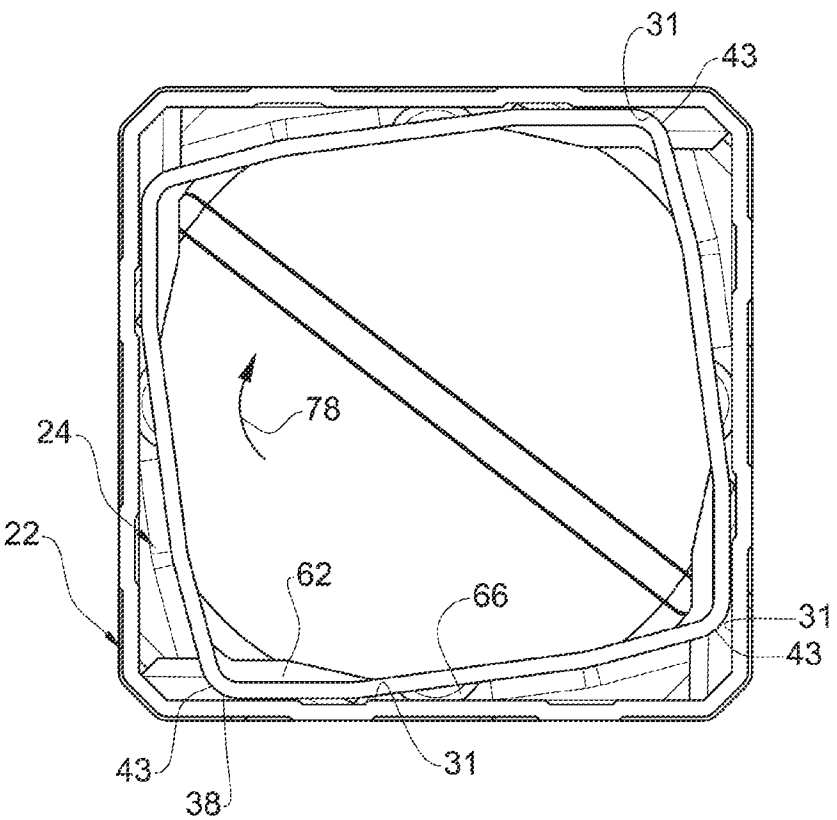
FIG. 6A is a planar section along line IX-IX in FIG. 1B.
Figure 7C:
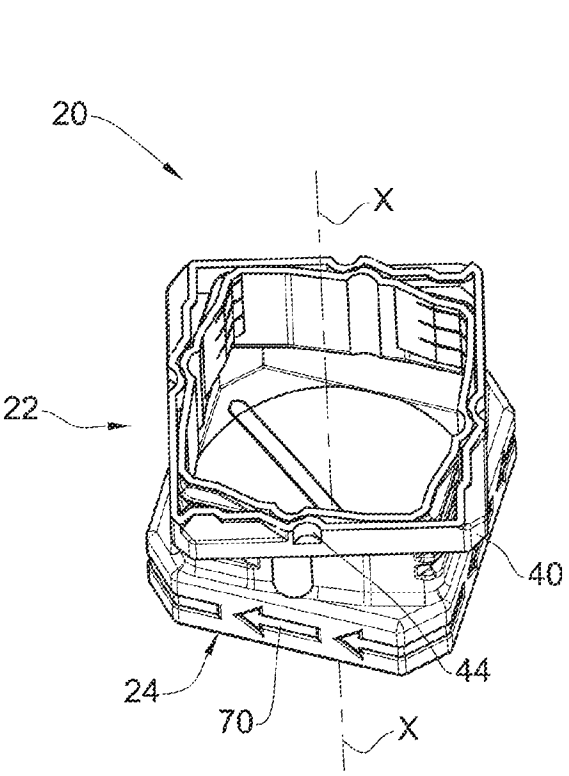
FIGS. 7A to 7C are consecutive isometric sections along section lines XI-XI, XII-XII, and XIII-XIII, respectively, in FIG. 1A.
Figure 7B:
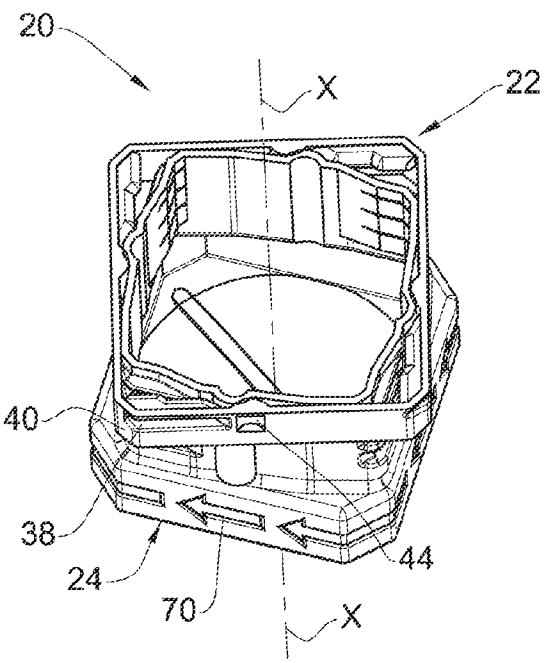
Figure 7A:
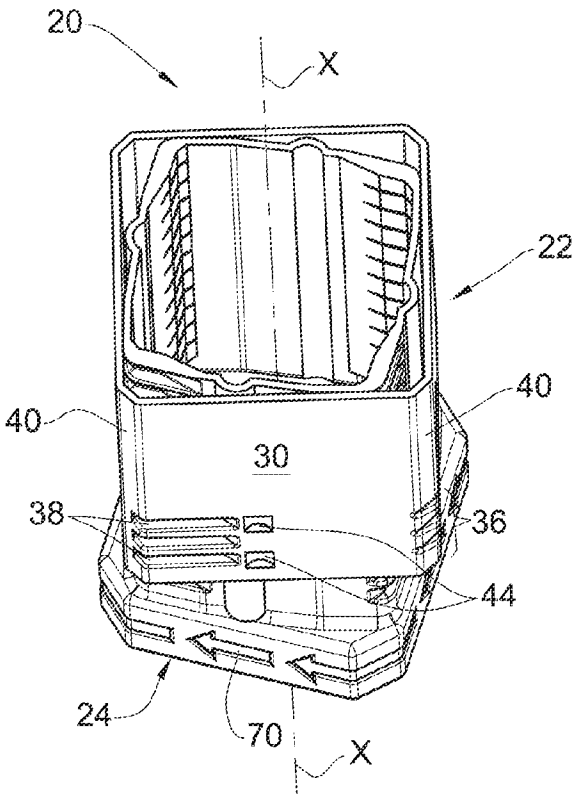

It is further noted that the polygonal portion 48 of the receiving member 24 is slidingly displaceable within the polygonal locking neck portion 36 of the cover member 22 (referred to as the unlocked/open position; FIGS. 1A, 1D, 6B) only when the flat face portion 56 of the receptacle member 24 is substantially parallel with the inside flat wall surface 31 of the polygonal locking neck portion (and along the cover member 22), at which position the locking teeth 62 of the receptacle member 24 are disengaged from the arresting teeth 38 of the cover member 22. Likewise, the receptacle member 24 is axially arrested within the cover member (referred to as the locked/closed position; FIGS. 1B, 1C, 5A-5F, 6A) when the arresting portion 58 of the receptacle member 24 is disposed substantially parallel with the inside wall surface 31 of the cover member 22.

Further noted, the manipulating portion 50 of the receptacle member 24 comprises an easily gripped rectangular shape and provided with indicia arrows 70 indicating the direction of twisting the second member into the locked position Similar arrow indicia 74, however at reverse direction, is applied onto a top portion of the cover member 22. The manipulating portion 50 has an external shape substantially similar to that of an external shape the cover member 22, such that at the fully retracted, locked/closed position the manipulating portion coextends with the first member (FIGS. 1B and 5A-5E).

The arrangement according to the disclosure is such that the receptacle member 24 is angularly displaceable (twisted) within the cover member 22 between the unlocked/open position (FIGS. 1A, 1D, 6B) and locked/closed position (FIGS. 1B, 1C, 5A-5F, 6A). At the unlocked position the locking teeth 62 of the receptacle member 24 are disengaged from the arresting teeth 38 of the cover member 22 and are spaced apart to thereby facilitate free axial (telescopic) displacement of the receptacle member 24 within the cover member 22. Angular displacement of the receptacle member 24 within the cover member 22, into the unlocked position, is restricted upon engagement of the corners 43 of the receptacle member 24 with the respective inside walls 31 of the cover member 22.

However, upon angular displacement of the receptacle member 24 within the cover member 22 (in direction of arrow 78 in FIG. 6A; corresponding with indicia arrows 70 and 74 applied over the receptacle member 24 and the cover member 22, respectively), the locking teeth 62 become engaged with the arresting teeth 38, and the first member and the second member are now axially engaged, thus preventing axial displacement therebetween.

It is noted however that twisting into the locked position requires snap arresting of the longitudinally extending ridge 66 beyond the projecting bulges 44, such that the first member and second member maintain their arrested, locked position.

The arresting teeth 38 of the cover member 22, and the plurality of locking teeth 62 of the receptacle member 24 are equally spaced along an axial path and are further of uniform thickness (axially measured), so as to substantially reduce or eliminate axial freedom between the first member and the second member, at the locked position.

It will be recognized that at the unlocked position, the flat face portion of the second member is substantially parallel and flush against the inside wall surface of the polygonal locking neck and the arresting portion extends at an angle with respect to the inside wall surface thus giving rise to space between the locking teeth and at least one arresting member. At the locked position an opposite situation takes place wherein the flat face portion extends at an angle with respect to the inside wall surface and respectively the arresting portion extends substantially parallel and flush with respect to the inside wall surface so that respective locking teeth engage with the at least one arresting member.

According to a modification of the disclosure (not shown) the arresting teeth and/or the locking teeth may be disposed as an inclined or coiled pattern, whereby rotational displacement (twisting) of the first member with respect to the second member, entails simultaneous axial displacement. This arrangement is useful in order to tighten closure of the first member over an article received in the second member.

Figure 8:
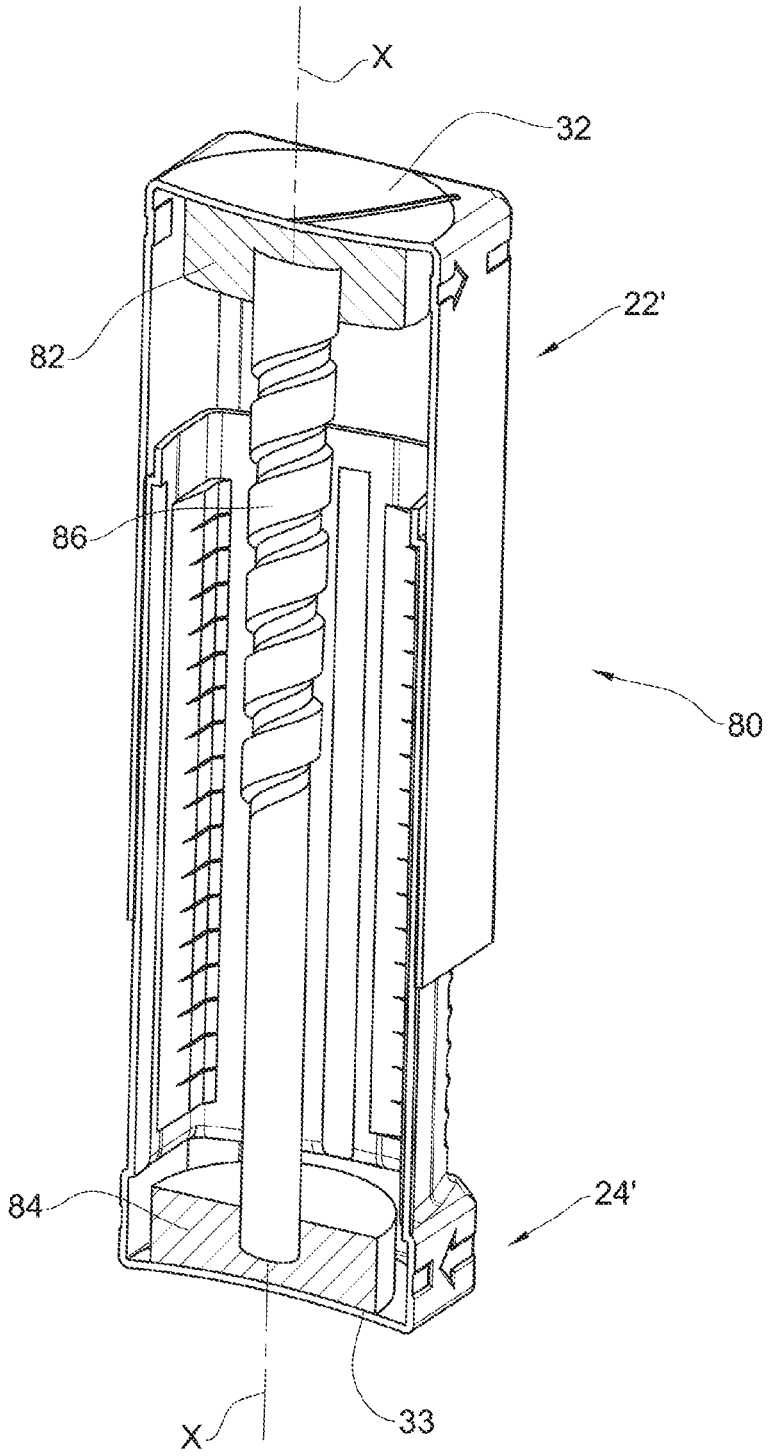
FIG. 8 illustrates a container according to the disclosure, wherein the first cover member and the receptacle member comprise a tool receiving/supporting portion.

Turning now to FIG. 8 of the drawings there is illustrated a modification of the container illustrated hereinabove, generally designated 80, wherein both of the cover member 22' and the receptacle member 24' comprise a tool receiving/supporting portion designated 82 and 84 respectively, wherein a tool (e.g., drill bit 86) is securely arrested at a motion free configuration.

The arrangement is such that in use, the polygonal portion 48 of the receptacle member 24' is introduced into the cover member 22' through the polygonal locking neck 36, until the tool 86 bears against both the top base 33 of the cover member and the bottom base 33 of the receiving member, thereby applying pressure between the two members.

Figure 9A:
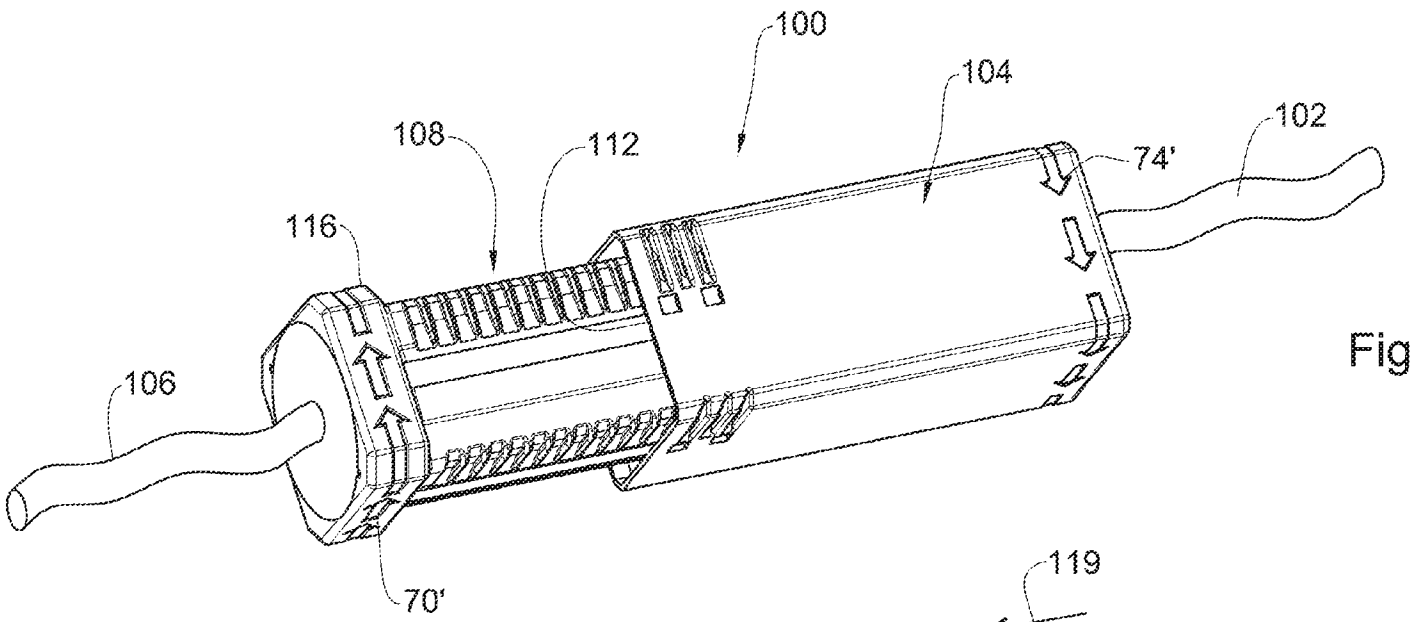
FIGS. 9A and 9B are perspective views of a coupler according to an example of the presently disclosed subject matter, at a slack, unlocked position, and at a tensioned, locked position, respectively.
Figure 9B:
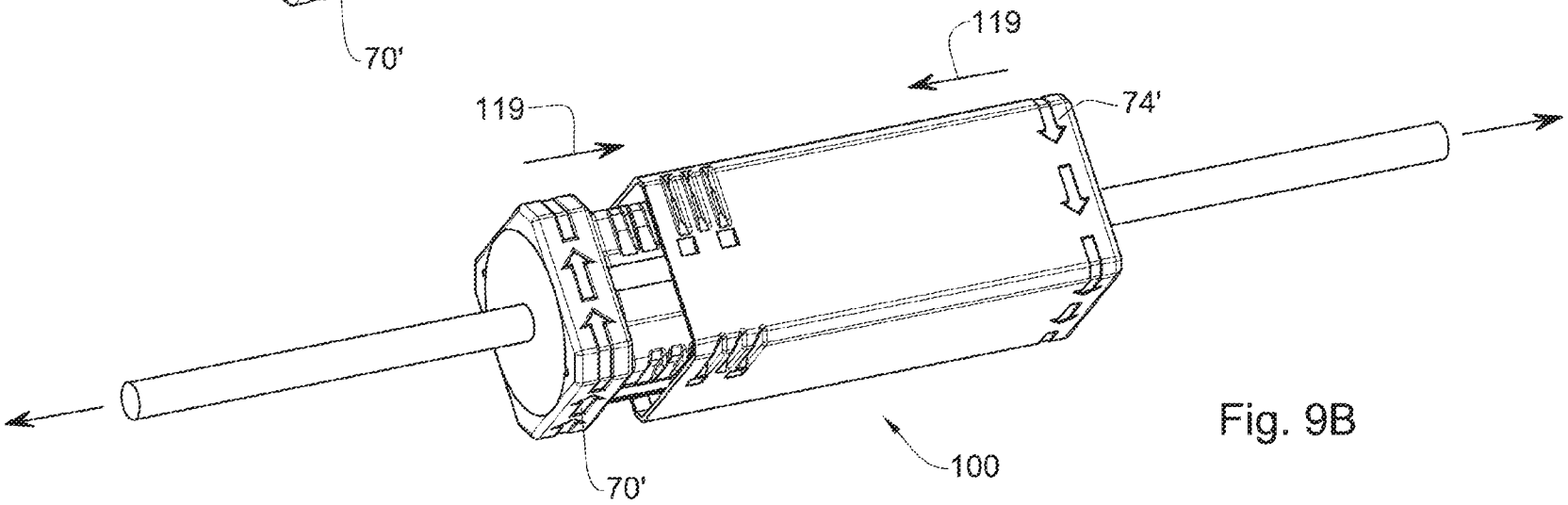

In FIGS. 9A and 9B of the drawings there is illustrated a different example of an article according to the presently disclosed subject matter, however following the same principals. In the drawings there is provided a coupler 100 configured for coupling a first cord 102 articulated to a first member 104, to a second cord 106 which in turn is articulated to a second coupler member 108. The first member 104 and the second member 108 are substantially similar in structure and in operation to the arrangement disclosed herein above with reference to FIGS. 1 to 7, whereby in FIG. 9A the coupler 100 is at the unlocked position and the neck end 112 of the first member 22' is remote from the manipulating portion 116 of the second member 24', so that the cords 102 and 106 are slack/lose. However, advancing the neck end 112 of the first member 22' towards the manipulating portion 116 of the second member 24' (in direction of arrows 119; FIG. 9B) results in tensioning the cords 102 and 104, whereby the two members are retained at this position by twisting the two members in direction of indicia arrows 70' and 74'.

The invention claimed is:

1. A container, comprising:

a first member and a second member at least partially slidingly received within said first member and axially displaceable therewithin and configured for selective axial arresting within said first member, said first member comprising at least a polygonal locking neck telescopingly receiving a polygonal portion of the second member;

an inside wall surface of said polygonal locking neck comprising at least one arresting member and an angular locking member, wherein the at least one arresting member of the first member includes one or more arresting teeth;

at least one external face of the polygonal portion of the second member comprising a flat face portion and an arresting portion extending at a reflex angle with respect to said flat face portion, and a plurality of locking teeth disposed along said arresting portion, each configured for engaging with the at least one arresting member;

said flat face portion being partitioned from the arresting portion by an axially extending angular arresting member configured for being arrested by said angular locking member;

said angular locking member being configured for selectively arresting the angular arresting member and retaining the second member at a locked position at which the at least one arresting member is engaged with at least one of the plurality of locking teeth of the second member, thereby preventing axial displacement thereof; and the polygonal portion of the second member being slidingly displaceable within the polygonal locking neck of the first member only when the flat face portion is parallel with the inside wall surface of the polygonal locking neck and further wherein the second member is axially arrested within the first member when the arresting portion is parallel with the inside wall surface of the polygonal locking neck.

2. The container according to claim 1, wherein the second member is angularly displaceable within the first member between an unlocked position and the locked position; wherein at the unlocked position the plurality of locking teeth of the second member are disengaged from the at least one arresting member of the first member and are spaced apart to thereby facilitate free axial displacement of the first member and the second member, and upon angular displacement of the second member within the first member at least one of the plurality of locking teeth becomes engaged with the at least one arresting member and the first member and the second member are axially engaged preventing axial displacement therebetween.

3. The container according to claim 1, wherein at an unlocked position, the flat face portion of the second member is parallel and flush against the inside wall surface of the polygonal locking neck and the arresting portion extends at an angle with respect to the inside wall surface of the polygonal locking neck, thereby giving rise to space between the plurality of locking teeth and at least one arresting member and at the locked position an opposite situation takes place wherein the flat face portion extends at an angle with respect to the inside wall surface of the polygonal locking neck and respectively the arresting portion extends parallel and flush with respect to the the inside wall surface of the polygonal locking neck so the respective locking teeth of the plurality of locking teeth engage with the at least one arresting member.

4. The container according to claim 1, wherein the first member is a cover member and the second member is a receptacle member.

5. The container according to claim 4, wherein at least one of the first and second member comprises a tool receiving portion.

6. The container according to claim 1, being a coupler configured for coupling two elements to one another.

7. The container according to claim 1, wherein each of the first member and the second member comprise, at a respective opposite end thereof, locking features similar to those of the first member or the second member.

8. The container according to claim 1, wherein the first member and the second member each comprise a corresponding polygonal shape, said polygonal shape extending the entire length of at least the respective first member.

9. The container according to claim 1, wherein the one or more arresting teeth and the plurality of locking teeth intersect a longitudinal axis of the first member and the second member at a right angle.

10. The container according to claim 1, wherein the plurality of locking teeth of the second member and the one or more arresting teeth of the first member are equally distributed along an axial path.

11. The container according to claim 1, wherein the first member is angularly arrestable with respect to the second member at the locked position.

12. The container according to claim 1, wherein the at least one arresting member of the first member is configured as one or more inward projection extending from the inside wall surface of the polygonal locking neck, and configured for snapingly arresting at any axial location, over a longitudinal ridge projecting along the external face of the polygonal portion of the second member.

13. The container according to claim 1, wherein angular displacement of the second member within the first member, into an unlocked position, is restricted upon engagement of the corners of the second member with the respective inside wall surfaces of the first member.

14. The container according to claim 1, wherein the second member comprises a manipulating portion at a bottom end thereof.

15. The container according to claim 14, wherein the manipulating portion has an external shape similar to that of an external shape the first member, such that at a fully retracted, locked position said manipulating portion coextends with the first member.

16. The container according to claim 1, wherein the at least one arresting member of the first member, and the plurality of locking teeth of the second member, are equally spaced along an axial path and are of uniform thickness, so as to reduce or eliminate axial freedom between the first member and the second member, at the locked position.

17. The container according to claim 1, having a rectangular cross-section, and wherein the at least one arresting member is disposed at a respective side wall, adjacent a following corner thereof, and said arresting portion of the second member are a plurality of arresting portions each comprising said plurality of locking teeth which are disposed at a following relation and in correspondence with the positioning of the at least one arresting member.

18. The container according to claim 1, wherein one or both of the at least one arresting member and the plurality of locking teeth are provided at an inclined or coiled pattern, whereby rotational displacement of the first member with respect to the second member, entails simultaneous axial displacement.

* * * * *